US005167209A

United States Patent [19]

Dufern et al.

[11] Patent Number: 5,167,209

[45] Date of Patent: Dec. 1, 1992

[54] ENGINE FILTER ASSEMBLY

[76] Inventors: Richard L. Dufern, 2105 Tepee Ave., Carpentersville, 60110; George Riddiford, 35 W. 315 Chateau Dr., West Dundee, Ill. 60118

[21] Appl. No.: 846,618

[22] Filed: Mar. 5, 1992

[51] Int. Cl.[5] ..... F02B 77/00

[52] U.S. Cl. ..... 123/198 E; 123/41.65

[58] Field of Search ..... 123/41.65, 41.7, 185.2, 123/185.3, 198 E; 55/DIG. 13

[56] References Cited

U.S. PATENT DOCUMENTS

| | | | |
|---|---|---|---|
| 2,445,965 | 7/1948 | Packwood | 56/12.8 |
| 2,601,907 | 7/1952 | Burrows et al. | 55/406 |
| 2,736,301 | 2/1956 | Medenus | 123/41.65 |
| 2,848,987 | 8/1958 | Morden | 123/185.4 |
| 2,972,340 | 2/1961 | Bertsch | 123/41.7 |
| 3,147,814 | 9/1964 | Suhre | 180/54 |
| 3,183,899 | 5/1965 | Tuggle | 123/41.65 |
| 3,252,449 | 5/1966 | Couchman, Jr. | 123/41.65 |
| 3,744,468 | 7/1973 | Braun | 123/185.2 |
| 3,994,067 | 11/1976 | Hazzard et al. | 123/41.7 |
| 4,134,370 | 6/1979 | Iwahashi et al. | 123/41.65 |
| 4,261,302 | 4/1981 | Sheldon | 123/41.7 |
| 4,438,733 | 3/1984 | Sasaki | 123/41.65 |
| 4,446,681 | 5/1984 | Dynie et al. | 123/41.65 |
| 4,770,262 | 9/1988 | Yasunaga et al. | 123/41.65 |
| 4,946,482 | 8/1990 | Tamba et al. | 123/41.65 |
| 4,970,993 | 11/1990 | Weiss et al. | 123/41.7 |
| 4,998,510 | 12/1991 | Rognon | 123/41.7 |

*Primary Examiner*—Noah P. Kamen

*Attorney, Agent, or Firm*—Hill, Van Santen, Steadman & Simpson

[57] ABSTRACT

An air filter arrangement for a gas engine which is used in a dirty environment such as roof removing machines which covers the air inlet to the fan and consists of an annular air filter and a foam air filter which fit over the fan air inlet and which is held in place by a plate that attaches it to the engine.

8 Claims, 2 Drawing Sheets

ENGINE FILTER ASSEMBLY

BACKGROUND OF THE INVENTION

1. Field of the Invention

This invention relates in general to filters and in particular to a filtration system for filtering the air intake into the cooling fan of an engine.

2. Description of Related Art

The following U.S. patents illustrate various filtering arrangements for engines U.S. Pat. Nos. 2,445,965, 2,601,907, 2,736,301, 2,848,987, 2,972,340, 3,147,814, 3,183,899, 3,252,449, 3,994,067, 4,134,370, 4,261,302, 4,438,733, 4,446,681, 4,770,262, 4,970,993, 4,998,510.

Gas driven engines when operated in dirty environments such as in roof removing machines experience motor over-heating and motor failure due to the contaminants which clog the air cooling intakes. Although protective screens have been provided for motors, they do not provide adequate filtration in high debris environments such as where roofing removed machines are used. It is common for debris to be sucked into the fan area and thereafter to coat the fan blades and also to coat the other internal machine parts including the heat dissipating fins which reduces their efficiency. This causes the motor to overheat which can lead to failure of the engine.

SUMMARY OF THE INVENTION

The present invention relates to a filtering system for an engine which includes an air filter system that surrounds the fan air intake at the recoil starter housing. A pair of axially spaced plates are mounted to the engine with one under the recoil openings and one spaced axially out from the recoil housing with a series of spacer bolts extending between the two and attaching the assembly to the machine motor housing. The air filtration system utilizes standard purchased components including a circular ring folded paper filter of the type normally used, for example, in automotive carburetor filters. That filter is surrounded by a foam filter which can be oil saturated and these two filters are held in place between the spaced plates. An airtight seal is maintained due to the rubber sealing at the axial ends of the folded paper filter.

The foam filter can be easily removed and cleaned and the foam material gives a very clear visual indication of the degree of contamination so that the operator will have a visual indication when the filter must be cleaned.

It is an object of the present invention to provide an improved filtering system for the air cooling intake of a gasoline engine.

It is an object of the present invention to provide an engine filter assembly which prevents the engine from being clogged and over-heated due to contaminants in the environment in which the engine is being operated.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure, and in which:

DETAILED DESCRIPTION OF THE PREFERRED EMBODIMENTS

Figure 1:
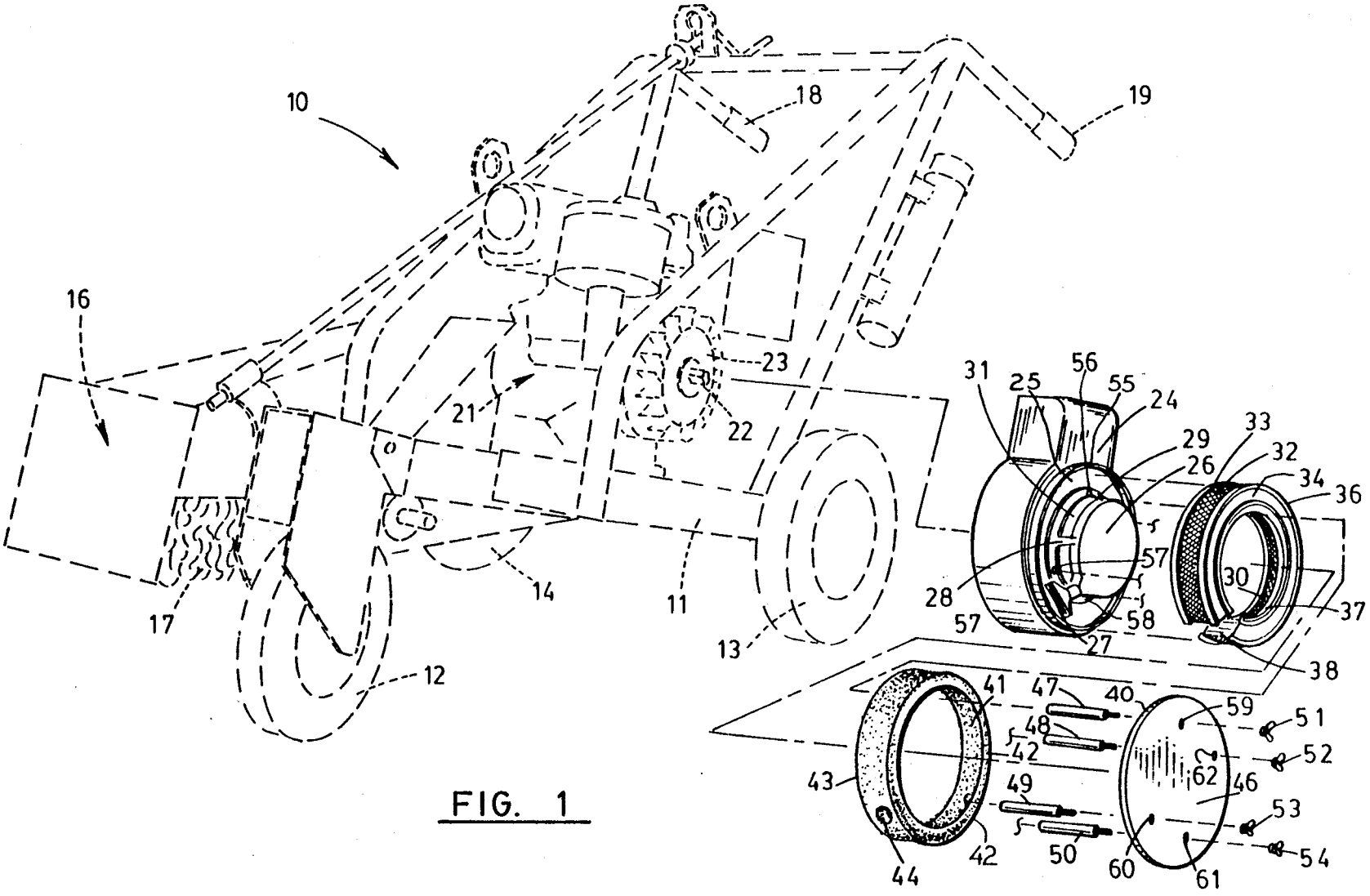
FIG. 1 is a perspective view illustrating the air filtering system in exploded arrangement.
Figure 3:
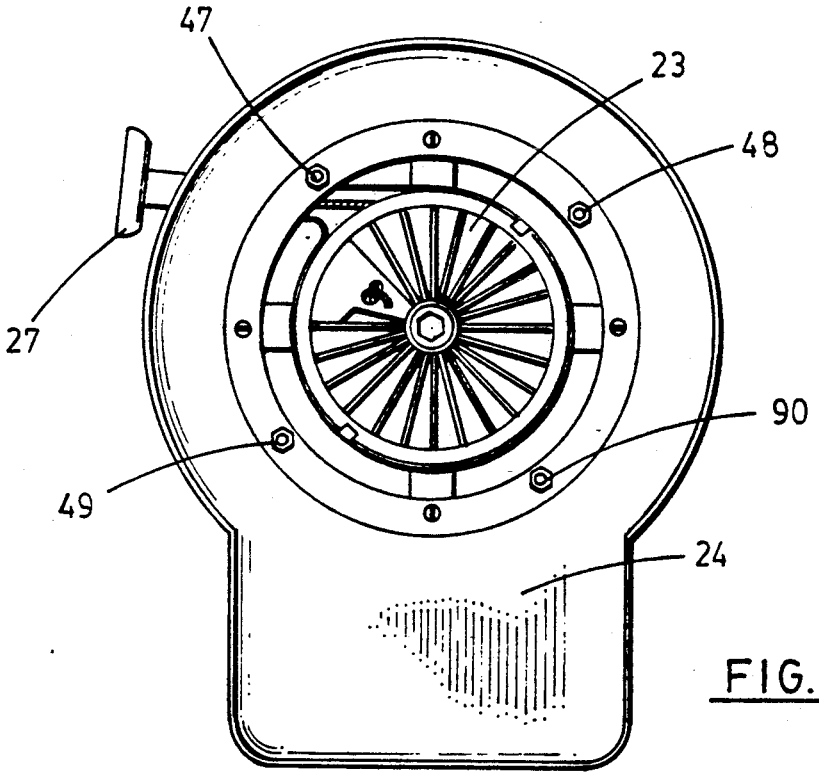
FIG. 3 is a plan view illustrating the fan and air intake of the motor.

FIG. 1 illustrates a roofing removal machine 10 which has a frame 11 which rotatably carries ground wheels 12, 13 and 14. A roof removing mechanism 16 has roofing engaging blades 17 which are driven by a gasoline engine 21. Handles 18 and 19 are used for guiding the machine. The engine 21 has an output shaft 22 which carries a fan 23 for supplying cooling air to the engine. A fan enclosing housing 24 covers the fan 23 and a recoil starter unit 26 is connected to the housing 24 and has a recoil starter handle 27. Spacers such as 28 and 29 space the recoil starter 26 from the housing 24 so as to provide air passages 31 so that air can enter through the housing 24 to the fan 23.

Figure 2:
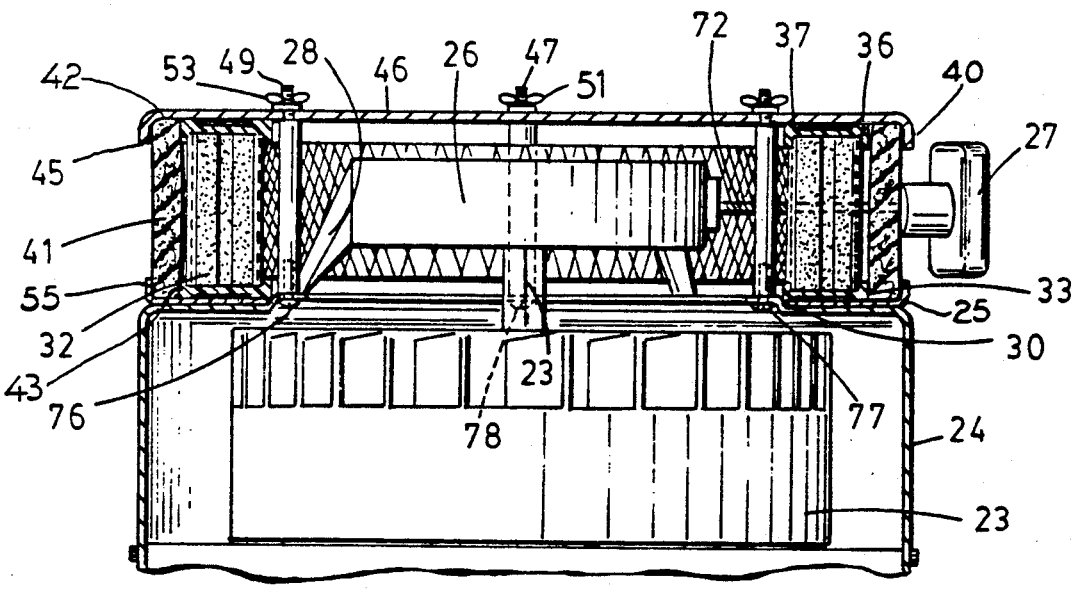
FIG. 2 is a sectional view taken to include the air filter arrangement.

As best shown in FIGS. 1 and 2, an annular member 25 with an outer rim 55 engages the outer surface of the housing 24. A circular ring-type folded paper filter 32 is formed with a gap 38 and fits over the recoil starter housing 26 against annular member 25. Rubber seals 37 and 36 are formed on one side of the filter 32 and seals 33 and 30 are formed on the other side of the filter 32. The filter 32 is placed over the recoil housing 26 against annular member 25 on the fan housing 24 with the pull handle 27 of the recoil starter extending through the gap 38 of the filter. An annular foam filter 41 with opposite edges 42 and 43 has an inner diameter so that it can fit over the filter 32 and is formed with a hole 44 through which the pull handle 27 can be fitted. A disc-shaped plate 46 with a rim 40 fits over the filters 32 and 41 and with annular member 25 holds them to the housing 24. A plurality of bolts 47, 48, 49 and 50 are internally threaded at first ends which pass through openings such as 56, 57, 58 in housing 24 and receive nuts such as 76 and 77 illustrated in FIG. 2 on their inner ends so as to hold the bolts to the housing 24. The other ends of the bolts pass through the filters 32 and 41 and through openings 59, 60, 61 and 62 in plate 46 and thumb screws 51, 52, 53 and 54 are received on extended threaded portions so as to lock the filters 41 and 32 to the housing 24 between plate 48 and member 25.

The filter 41 may be dipped in oil so as to assist in removing particulate from incoming air.

In use, after the filters 32 and 41 have been installed by tightening thumb screws 51, 52, 53 and 54 on the bolts 47, 48, 49 and 50 so as to lock the plate 46, member 25 and filters 32 and 41 to the engine, the engine is started by pulling the handle 27 so that the fan 23 draws air through the filters 41 and 32 into the air cooling system of the engine. Since the filters 41 and 32 remove the particulate matter from the intake air, the fan 23 will not be coated with contaminants and also the cylinders and other cooled regions of the engine will not be coated with particulate materials. After operation for fixed periods, the operator can observe the condition of the filter 41 since its outer surface is visible and if the outer surface becomes substantially covered with contaminants, the engine 21 can be stopped and the filters 41 and 32 removed and cleaned and replaced by merely loosening the thumb screws 51, 52, 53 and 54 thus removing the plate 46 from the engine after which the filters 41 and 32 can be removed. The filter 41 can be washed and oiled and the filter 32 can be shaken or blown clean with a suitable air supply. Then the filter 32 and filter 41 are replaced between member 25 and the plate 46 and the thumb screws 51, 52, 53 and 54 are tightened and the engine is in operating condition.

It is seen that the present invention provides novel air filter means and although the invention has been described with respect to preferred embodiments, it is not to be so limited as changes and modifications can be made which are within the full intended scope of the invention as defined by the appended claims.

We claim as our invention

1. A filter system for the fan air input for an internal combustion engine with a recoil starter comprising, a fan housing formed with an extension in which said recoil starter is mounted, fan air intake openings formed in said fan housing around said recoil starter, an annular air filter mounted on said fan housing and surrounding said recoil starter so as to filter air entering said air intake opening, and a plate attached to said fan housing over said air filter to hold and seal said air filter.

2. A filter system for the fan air input for an internal combustion engine with a recoil starter according to claim 1 including an annular member mounted between said fan housing and said air filter and sealing gaskets mounted between said air filter and plate and between said air filter and said annular members.

3. A filter system for the fan air input for an internal combustion engine with a recoil starter according to claim 2 wherein said sealing gaskets are attached to said air filter.

4. A filter system for the fan air input of an internal engine with a recoil starter according to claim 2 wherein said plate has a first rim and said annular member has a second rim and said annular air filter is held within said first and second rims.

5. A filter system for the fan air input for an internal combustion engine with a recoil starter according to claim 1 wherein an opening is formed in the annular air filter through which a pull cord and handle of said recoil starter extends.

6. A filter system for the fan air input for an internal combustion engine with are coil starter according to claim 1 wherein said air filter consists of a first annular filter of the circular ring-type folded paper filter.

7. A filter system for the fan air input for an internal combustion engine with a recoil starter according to claim 6 wherein said air filter consists of a second annular filter of foam material which surrounds said first annular filter.

8. A filter system for the fan air input for an internal combustion engine with a recoil starter according to claim 1 wherein said plate is attached to said fan housing by a plurality of bolts and nuts.

* * * * *